US005141161A

United States Patent [19]

Anderson et al.

[11] Patent Number: 5,141,161

[45] Date of Patent: Aug. 25, 1992

[54] HVLP SPRAY GUN

[75] Inventors: Richard D. Anderson, Maple Grove, Minn.; Carl D. Jacobsen, Hudson, Wis.

[73] Assignee: Graco Inc., Minneapolis, Minn.

[21] Appl. No.: 683,246

[22] Filed: Apr. 10, 1991

[51] Int. Cl.[5] ..... B05B 7/04

[52] U.S. Cl. ..... 239/300; 239/290; 239/353; 239/390; 239/414

[58] Field of Search ..... 239/290, 300, 353, 390, 239/414, 416.2, 526, 600, 583

[56] References Cited

U.S. PATENT DOCUMENTS

| | | | |
|---|---|---|---|
| 734,473 | 7/1903 | Shepler . | |
| 1,232,618 | 7/1917 | Smart . | |
| 1,436,145 | 11/1922 | Birkenmeier . | |
| 1,650,686 | 11/1927 | Binks | 239/290 |
| 1,651,466 | 12/1927 | Norris . | |
| 1,706,006 | 3/1929 | Thompson | 239/300 |
| 1,751,608 | 3/1930 | Tittlemore . | |
| 1,940,268 | 12/1933 | Peterson | 239/526 |
| 2,759,772 | 8/1956 | Hopkins | 299/140 |
| 2,804,343 | 8/1957 | Friedell | 299/140 |
| 2,888,207 | 5/1959 | Sykes | 239/353 |
| 4,426,039 | 1/1984 | Kwok | 239/415 |
| 4,708,292 | 11/1987 | Gammons | 239/600 |

FOREIGN PATENT DOCUMENTS

| | | | |
|---|---|---|---|
| 941351 | 7/1954 | Fed. Rep. of Germany | 239/290 |

*Primary Examiner*—Andres Kashnikow
*Assistant Examiner*—Lesley D. Morris
*Attorney, Agent, or Firm*—Douglas B. Farrow

[57] ABSTRACT

A spray gun designed for high volume low pressure (HVLP) use is provided with a simple yet effective mechanism for providing feathering as well as allowing for extended needle and nozzle life. A poppet member is spring biased and moves some distance to first initiate air flow prior to initiation of fluid flow. The needle nozzle combination is provided with geometry such that the location of highest velocity is separate from the seating area so as to minimize wear of the seating areas and thus extend life. A two stage pressure drop is utilized for use with plant air. The two stage drop provides more consistent results.

7 Claims, 3 Drawing Sheets

HVLP SPRAY GUN

BACKGROUND OF THE INVENTION

HVLP spray guns have been known and used for a number of years now. Most such guns have been provided with a low pressure high volume source of compressed air such as a turbine and which requires that the gun constantly bleed air to atmosphere because the air source cannot run against a closed system when the device is not being operated.

Also, some guns are provided which utilize regular "plant" compressed air and which lower the air pressure within the gun to usable levels (less than 10 psi at the air cap). Paint and other coating materials over the years have gotten more abrasive as solid levels in such substances have increased to the point where the wear in the nozzle of the spray gun has become an issue to deal with.

SUMMARY OF THE INVENTION

In the instant invention the needle of the spray gun is formed of two pieces, a base member and a tip, the tip being the replaceable member while the base generally stays in the gun even during replacement, it being the base which has the fluid packing seals bearing against it. The lack of need to replace this base member greatly increases the life of the fluid packings referred to above.

In the instant invention, the nozzle is formed of a material such as stainless steel and the needle formed of a plastic material such as acetyl homopolymer. It may easily and consistently manufactured to produce a high quality spray.

The geometry in the nozzle is such that the point of sealing and contact when the nozzle is shut off has a cross sectional location and area such that when it is open, that cross sectional area is larger than a cross sectional area elsewhere in the device. By providing the smallest cross sectional area during operating flow at a location different from the seat, that moves the point of highest wear (the point of minimal cross sectional area) away from the point of sealing which then greatly enhances service life of both the needle and seat.

The dual tapers which are provided, the deice may easily be feathered to produce the characteristics of the traditional air spray guns which are valued by operators at paint shops.

The valve for opening air and fluid flow is designed to provide the desirable lead/lag air flow characteristics also associated with conventional air spray paint guns. In particular, a poppet sleeve is slideably located over the needle shaft and is provided with a seating area which seals off the air port to the front end of the gun. The rear end of the poppet is spring biased to close the air port and when first opened moves backwardly until the rear contacts a shoulder on the needle which is also spring loaded to close the fluid nozzle. When the rear of the poppet contacts the shoulder, the needle is then opened from the nozzle and fluid flow is allowed to start. Providing adjustable stops in the gun body, the location of the air and fluid opening points may be varied.

A two stage pressure drop is utilized for use with plant air. The two stage drop provides more consistent results.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

FIG. 1 is a general cross sectional view showing the spray gun of the instant invention.

FIG. 1*a* is a side view showing interchangeable needle tips.

DESCRIPTION OF THE PREFERRED EMBODIMENT

Figures 1, 1A:
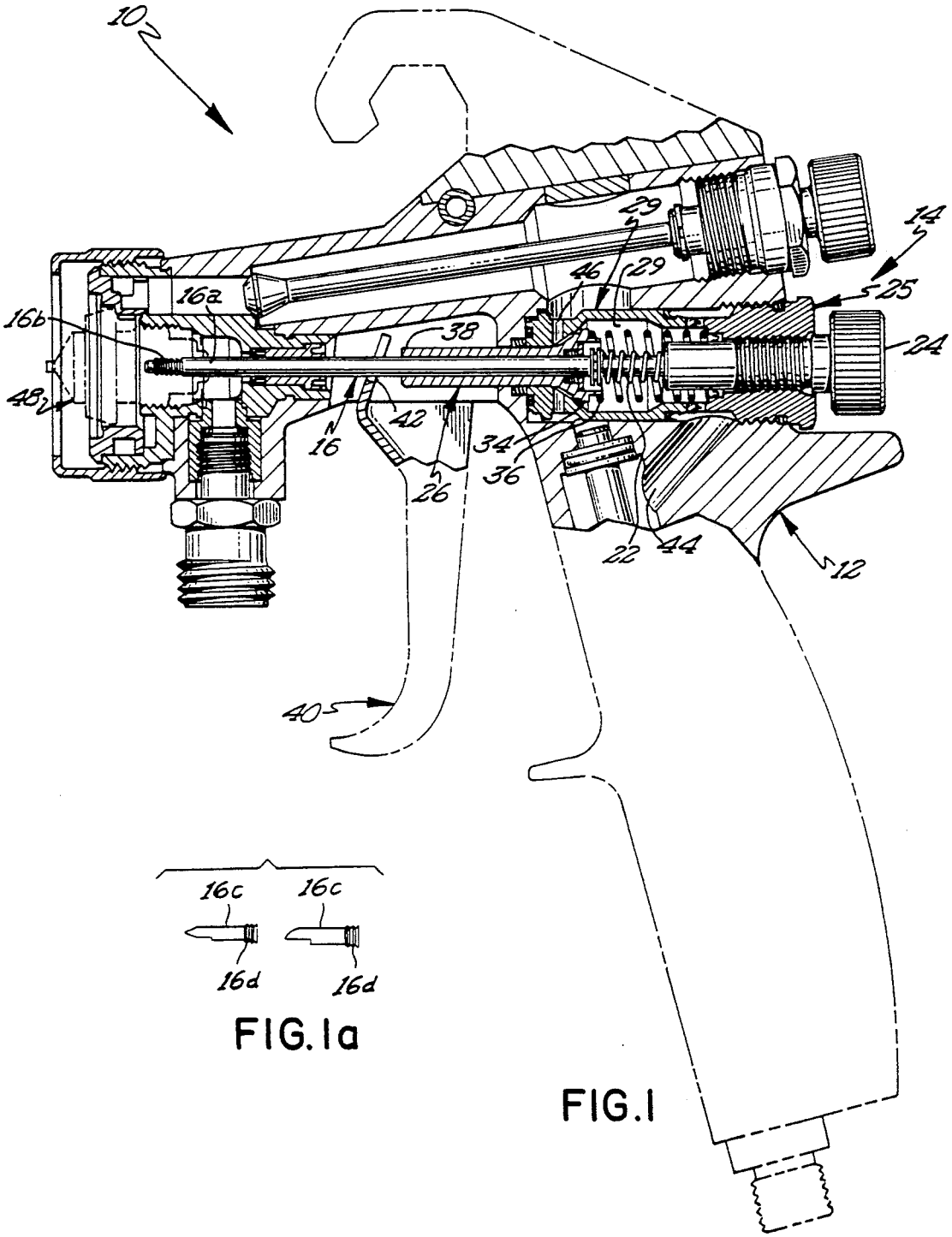
Figure 2:
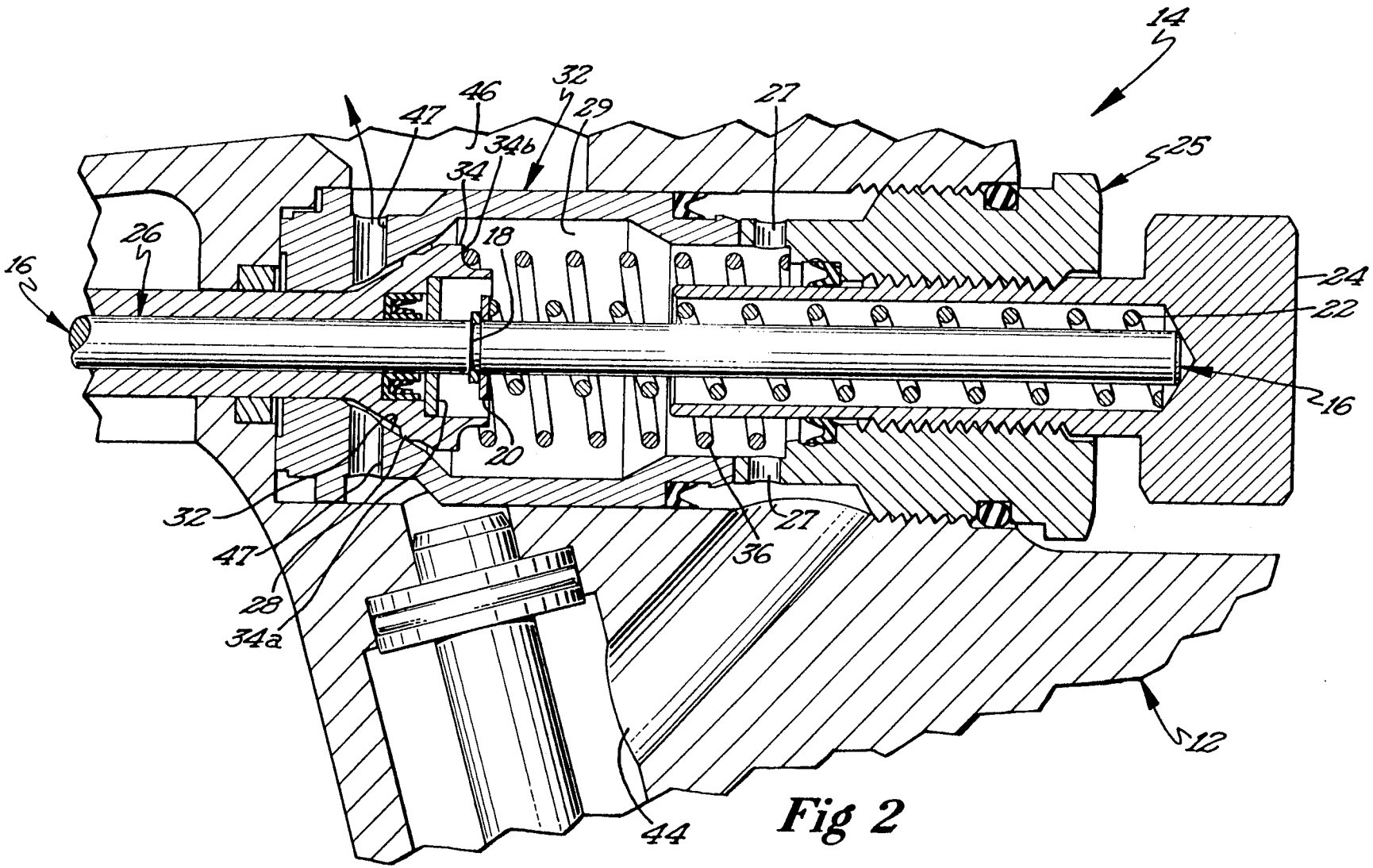
FIG. 2 is a cross sectional view showing in detail the poppet valve of the trigger of the instant invention.

The spray gun of the instant invention, generally designated 10 is shown in FIG. 1. Spray gun 10 is comprised of a body 12 which may be a cast or molded member. The poppet assembly 14 is threaded into the rear end of gun 10 and is shown in more detail in FIG. 2. A needle 16 has a shoulder 18 thereon which bears against a spring retainer 20 which is turn bears against needle spring 22. Needle spring 22 seats at its rear end in needle retainer 24 which is threadedly engaged in poppet spring retainer 25 which is in turn threadedly engaged in body 12.

Poppet 26 has a sealing area 28 on the front end thereof which seals against sealing area 30 of cartridge 32 which is inserted into body 12. The rear end 34 of poppet 26 has a needle engaging surface 34*a* and a spring engaging surface 34*b* which engages poppet spring 36. Poppet spring 36 at its other end is located by poppet retainer 25. FIG. 1 shows the front end 38 of poppet 26 which may be engaged by a fork 42 in trigger 40. When trigger 40 is pulled toward the handle or to the right as shown in FIG. 1, poppet 26 is pushed rearwardly compressing spring 36 until contacting surface 34*a* contacts spring retainer 20 thereby compressing needle spring 22 and allowing fluid to flow through the front end of the gun.

Because poppet 26 is compressed and moves a distance before needle 16 is moved, air which initially is supplied through air port 44 passes in the direction as shown by the arrow past sealing areas 28 and 30 and hence outwardly through port 46 to the front end of the spray gun for atomization and pattern control. FIG. 1 shows needle 16 but more importantly the base portion 16*a* of needle 16. The front end of needle base portion 16*a* has a threaded portion 16*b* on which is threaded needle tip 16*c* having threaded portion 16*d*.

Figure 3:
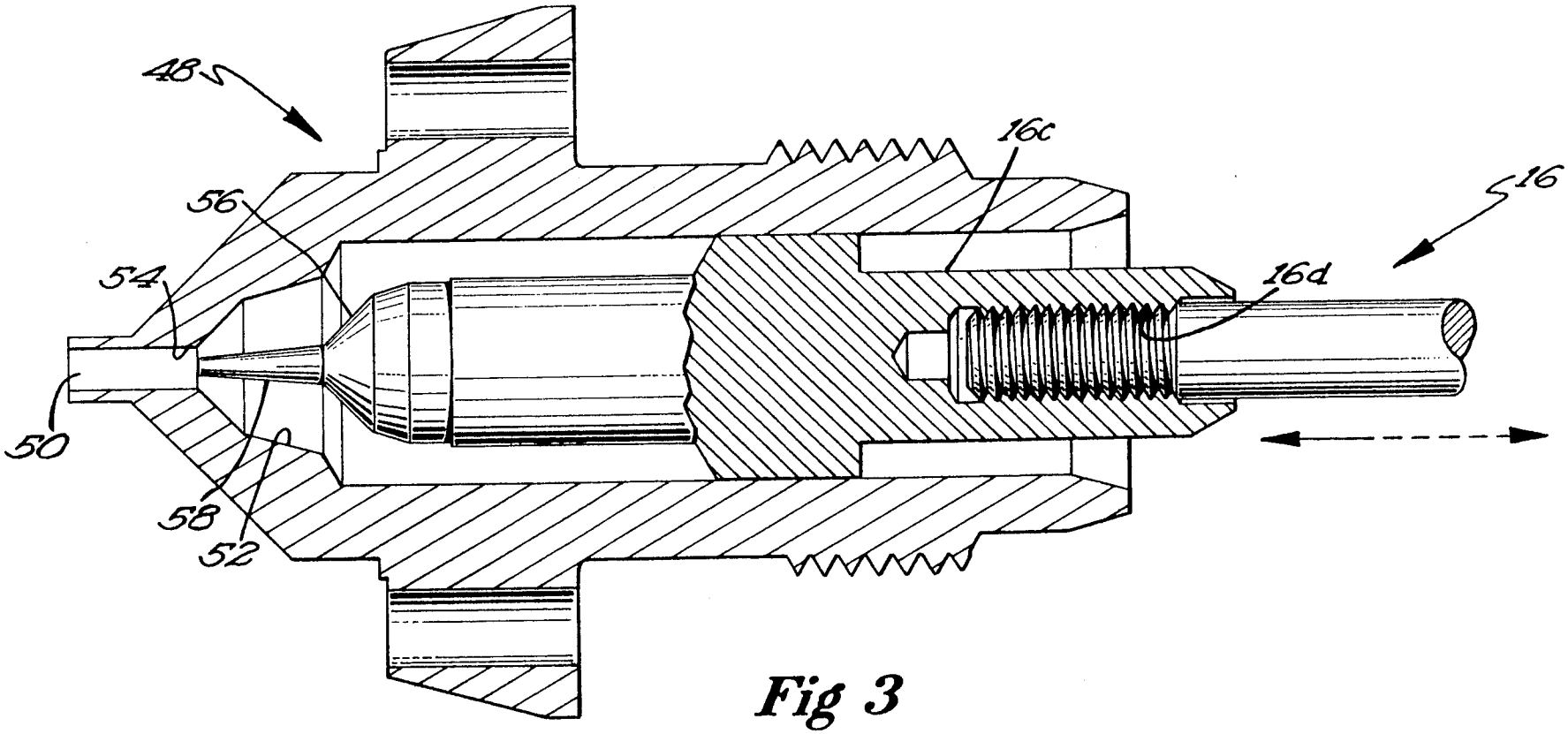
FIG. 3 shows in detail the front end of the spray gun particularly the nozzle and needle.

FIG. 3 shows in detail nozzle 48 and needle tip 16*c*. In particular, nozzle 48 has a central orifice 50 through which fluid may flow and includes a seat 52 and a restrictive area 54. Needle 16 has a sealing area 56 and a restrictive area 58. As can be seen in FIG. 3 wherein the solid lines represent needle 16 and sealing engagement with nozzle 48, the dotted lines show needle 16 retracted somewhat and it is clear that while seat 52 and sealing area 56 separate from each other as needle 16 is withdrawn, the smallest cross sectional flow area is presented at restrictive areas 54 and 58 rather than at seat 52 and sealing area 56. This results in by far the most significant wear taking place at restrictive areas 54 and 58 thereby allowing the sealing mechanism to have a relatively long life and the wear takes place at a relatively non-critical portion of the mechanism.

Nozzle 48 is produced in a single seat size and geometry such that flow characteristics may be varied by substituting different needle tips 16*c* on needle base 16*a*.

A dual stage pressure drop mechanism assures tighter pressure drop tolerances (at air cap pressures) from gun to gun as well as allowing looser tolerance on the restrictor holes. In particular, four holes 27 are located 90° apart on the poppet retainer 25 and serve to channel air from passage 44 into the chamber 29 behind poppet 26. When poppet 26 is opened, air passes through slot 47 to the front of the gun. For example, the first restrictor holes 27 drop 65 psi air to 20–25 psi while the second stage slot 47 drops pressure to the final 10 psi and makes the gun less sensitive to diameter tolerances or inlet pressure variations.

It is contemplated that various changes and modifications may be made to the spray gun without departing from the spirit and scope of the invention as defined by the following claims.

What is claimed is:

1. A spray gun for application of coating materials, said spray gun comprising:

a gun body;

a fluid nozzle comprising a bore and located in said gun body, said bore comprising a seat and a restrictive area a plastic fluid needle slideably located in said bore, said needle comprising a sealing area and a restrictive area, said needle areas being separate and located and sized such that when said sealing area is removed from contact with said seat, the cross-sectional area between said nozzle and needle restricted areas is substantially less than the cross-sectional area between said seat and said sealing area.

2. The spray gun of claim 1 wherein said restrictive areas are tapered to provide feathering of flow as said needle is reciprocated in said nozzle.

3. The spray gun of claim 1 further comprising a plurality of needle tips which may be interchanged in said gun and nozzle, each said needle tip being of a different size from one another so as to provide differing fluid flows.

4. The spray gun of claim 3 wherein each said needle has a replaceable tip and a needle base, said needle base remaining in said gun so that only said tip is normally replaced.

5. A spray gun for application of coating materials, said spray gun comprising:

a gun body;

a fluid nozzle comprising a bore and located in said gun body, said bore comprising a seat and a restrictive area a plastic fluid needle slideably located in said bore, said needle comprising a shoulder, a sealing area and a restrictive area, said needle areas being separate and located and sized such that when said sealing area is removed from contact with said seat, the cross-sectional area between said nozzle and needle restrictive areas is substantially less than the cross-sectional area between said seat and said sealing area;

a trigger pivotably attached to said gun body, said trigger having a contact point which reciprocates;

a poppet slideably located in said gun body for selective contact by said contact point and comprising:

a bore containing said needle in reciprocating relationship;

a rear end; said rear end being spaced from said shoulder; and an air sealing area;

a poppet string interposed between said rear end and said gun body; and a needle spring interposed between said shoulder and said gun body whereby as said trigger is activated, said air sealing area moves out of contact with a source of pressurized air in said gun body to allow air to the front of said gun while compressing said poppet spring until said poppet spring has been compressed sufficiently so that said rear end contacts said shoulder to compress said needle spring and initiate fluid flow between said seat and said sealing area.

6. A spray gun for application of coating materials, said spray gun comprising:

a gun body;

a fluid needle slidably located in said gun body, said needle comprising a sealing area and a shoulder;

a trigger pivotably attached to said gun body, said trigger having a contact point which reciprocates;

a poppet slideably located in said gun body for selective contact by said contact point and comprising:

a bore containing said needle in reciprocating relationship;

a rear end; said rear end being spaced from said shoulder; and an air sealing area;

a poppet string interposed between said rear end and said gun body; and a needle spring interposed between said shoulder and said gun body whereby as said trigger is activated, said air sealing area moves out of contact with a source of pressurized air in said gun body to allow air to the front of said gun while compressing said poppet spring until said poppet spring has been compressed sufficiently so that said rear end contacts said shoulder to compress said needle spring and initiate fluid flow between said seat and said sealing area.

7. The spray gun of claim 6, said spray gun further comprising:

an air inlet;

a first restrictor located in an air flow path between said air inlet and said poppet air sealing area;

an air cap attached to said gun body; and a second restrictor located in an air flow path between said poppet air sealing area and said air cap.

* * * * *

UNITED STATES PATENT AND TRADEMARK OFFICE

CERTIFICATE OF CORRECTION

PATENT NO. : 5, 141, 161

DATED : August 25, 1992

INVENTOR(S) : Anderson, Et al.

It is certified that error appears in the above-identified patent and that said Letters Patent is hereby corrected as shown below:

On the title page, Item [75]: please add:

Inventors: Tera McCutcheon

Signed and Sealed this

Twenty-first Day of September, 1993

Bruce Lehman

*Attest:*

BRUCE LEHMAN

*Attesting Officer*

*Commissioner of Patents and Trademarks*